US009067444B2

(12) United States Patent
Momose

(10) Patent No.: US 9,067,444 B2
(45) Date of Patent: Jun. 30, 2015

(54) RECORDING APPARATUS

(71) Applicant: SEIKO EPSON CORPORATION, Tokyo (JP)

(72) Inventor: Seigo Momose, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/219,564

(22) Filed: Mar. 19, 2014

(65) Prior Publication Data

US 2014/0285598 A1 Sep. 25, 2014

(30) Foreign Application Priority Data

Mar. 25, 2013 (JP) ..... 2013-062788

(51) Int. Cl.

| | |
|---|---|
| ***B41J 2/01*** | (2006.01) |
| ***B41J 29/17*** | (2006.01) |
| ***B41J 11/00*** | (2006.01) |
| ***B41J 29/38*** | (2006.01) |

(52) U.S. Cl.

CPC ..... *B41J 29/17* (2013.01); *B41J 11/007* (2013.01); *B41J 29/38* (2013.01)

(58) Field of Classification Search

CPC ..... B41J 13/12; B41J 13/08; B41J 15/048; B41J 11/007; B65G 15/00

USPC ..... 347/101

See application file for complete search history.

(56) References Cited

U.S. PATENT DOCUMENTS

| | | | | |
|---|---|---|---|---|
| 5,669,055 | A | 9/1997 | Thayer et al. | |
| 2008/0238977 | A1 | 10/2008 | Nishizaki et al. | |
| 2008/0239053 | A1 * | 10/2008 | Sakano | 347/104 |

FOREIGN PATENT DOCUMENTS

| | | | |
|---|---|---|---|
| JP | 10-010948 | A | 1/1998 |
| JP | 11-192694 | A | 7/1999 |
| JP | 2005-306568 | A | 11/2005 |
| JP | 2009-149019 | A | 7/2009 |
| JP | 2009-237262 | A | 10/2009 |
| JP | 2012-116617 | A | 6/2012 |

OTHER PUBLICATIONS

The extended European Search Report for European Application No. 14161595.5 mailed Jul. 7, 2014.

* cited by examiner

*Primary Examiner* — Julian Huffman
*Assistant Examiner* — Sharon A Polk
(74) *Attorney, Agent, or Firm* — Global IP Counselors, LLP

(57) ABSTRACT

A recording apparatus includes a transport mechanism and a plurality of cleaning sections. The transport mechanism has an adhesive belt configured and arranged to support a target recording medium thereon to intermittently transport the target recording medium. The cleaning sections are arranged from an upstream side to a downstream side along the adhesive belt in a moving direction to clean the adhesive belt. A distance between the cleaning sections is different to a transport distance which results from one cycle of intermittent transporting of the target recording medium and is also different to a cumulative transport distance which results from a plurality of times of intermittent transporting of the target recording medium.

8 Claims, 6 Drawing Sheets

RECORDING APPARATUS

CROSS-REFERENCE TO RELATED APPLICATIONS

This application claims priority to Japanese Patent Application No. 2013-062788 filed on Mar. 25, 2013. The entire disclosure of Japanese Patent Application No. 2013-062788 is hereby incorporated herein by reference.

BACKGROUND

1. Technical Field

The present invention relates to a recording apparatus which is provided with a transport mechanism which transports a target recording medium by the target recording medium being placed on a moving belt.

2. Related Art

In the prior art, recording apparatuses, which are provided with a transport mechanism which transports a target recording medium by the target recording medium being placed on a moving belt, are used. Out of such recording apparatuses, recording apparatuses are described which are provided with an adhesive belt, as the moving belt, where an adhesive, which holds the target recording medium by bonding such that the target recording medium is able to be peeled off, is coated on a surface where the target recording medium is placed.

For example, Japanese Unexamined Patent Application Publication No. H11-192694 discloses a recording apparatus which is provided with an endless belt, which transports a target recording medium by adhesion and fixing, and cleaning rollers which are formed of a porous polymer material on the peripheral surface of the endless belt.

SUMMARY

In recording apparatuses which record by discharging ink by scanning a recording head back and forth in a direction which intersects with a transport direction of a target recording medium, transporting of the target recording medium is intermittent transporting since it is necessary to transport the target recording medium to correspond to the back and forth scanning of the recording head.

However, in a recording apparatus with such a configuration which is provided with a cleaning section for an adhesive belt, there are portions where the abutting time of the adhesive belt with the cleaning section is long (portions which are cleaned by the cleaning section in a stationary state) and portions where the abutting time with the cleaning section is short (portions which are cleaned by the cleaning section in a moving state) accompanying the intermittent transport of the target recording medium. As a result, due to the differences in the abutting times of the adhesive belt and the cleaning section, there are cases of uneven wear where the adhesive on the adhesive belt is peeled off at the portions where the abutting time is long.

In addition, in recording apparatuses with such a configuration, when a plurality of cleaning sections are provided in order to increase the cleaning power of the adhesive belt, there are cases where portions which are cleaned by the cleaning sections at an upstream side (a front stage) in the moving direction of the adhesive belt in a stationary state overlap with portions which are cleaned by cleaning sections at a downstream side (a rear stage) in a stationary state due to the positions of the plurality of cleaning sections which are provided. In such cases, there are cases where uneven wear of the adhesive belt is remarkable.

Therefore, an object of the present invention is to achieve a recording apparatus which is provided with a plurality of cleaning sections for an adhesive belt which is able to intermittently transport a target recording medium where uneven wear of the adhesive belt, which results from intermittent transport of the target recording medium, is suppressed.

A recording apparatus according to one aspect includes a transport mechanism and a plurality of cleaning sections. The transport mechanism has an adhesive belt configured and arranged to support a target recording medium thereon to intermittently transport the target recording medium. The cleaning sections are arranged from an upstream side to a downstream side along the adhesive belt in a moving direction to clean the adhesive belt. A distance between the cleaning sections is different to a transport distance which results from one cycle of intermittent transporting of the target recording medium and is also different to a cumulative transport distance which results from a plurality of times of intermittent transporting of the target recording medium.

According to the present aspect, the distance between the cleaning sections is different to one cycle of the transport distance which results from the intermittent transporting of the target recording medium and is also different to any cumulative transport distance which results from a plurality of times of intermittent transporting of the target recording medium. As a result, portions which are cleaned by the cleaning section at the front stage in the stationary state and portions which are cleaned by cleaning sections at the rear stage in the stationary state do not overlap. Accordingly, it is possible to suppress uneven wear of the adhesive belt which results from intermittent transporting of the target recording medium.

A recording apparatus of a second aspect of the present invention is the recording apparatus of the first aspect, where the transport mechanism is preferably configured and arranged to transport the target recording medium by a single transport distance which is determined in advance as the transport distance which results from one cycle of the intermittent transporting, and the distance between the cleaning sections is preferably a non-integer multiple of the single transport distance.

According to the present aspect, in a recording apparatus which is able to transport the target recording medium one transport distance which is determined in advance as one cycle of the transport distance which results from the intermittent transporting, it is possible to suppress overlapping of portions which are cleaned by the cleaning sections at the front stage in the stationary state and portions which are cleaned by cleaning sections at the rear stage in the stationary state and to suppress uneven wear of the adhesive belt which results from intermittent transporting of the target recording medium.

A recording apparatus of a third aspect of the present invention is the recording apparatus according to the first aspect, where the transport mechanism is preferably configured and arranged to transport the target recording medium by a plurality of transport distances which are determined in advance as the transport distance which results from one cycle of the intermittent transporting, and the distance between the cleaning sections is preferably different to each of the transport distances and is also different to the cumulative transport distance of the transport distances.

Here, "able to transport the target recording medium a plurality of transport distances which are determined in advance as one cycle of the transport distance which results from the intermittent transporting" has a meaning which includes a configuration which is able to transport the target recording medium by transport distances which are different in a case of recording in one recording mode in addition to a configuration which is able to transport the target recording medium by transport distances which are different in a case of recording in one recording mode and a case of recording in another recording mode.

According to the present aspect, in a recording apparatus which is able to transport the target recording medium a plurality of transport distances which are determined in advance as one cycle of the transport distance which results from the intermittent transporting, it is possible to suppress overlapping of portions which are cleaned by the cleaning sections at the front stage in the stationary state and portions which are cleaned by the cleaning sections at the rear stage in the stationary state and to suppress uneven wear of the adhesive belt which results from intermittent transporting of the target recording medium.

A recording apparatus of a fourth aspect of the present invention is the recording apparatus according to the third aspect, where a number of the cleaning sections used when cleaning the adhesive belt is preferably changeable according to the transport distances using the transport mechanism.

According to the present aspect, it is possible to change the number of cleaning sections which are used when cleaning the adhesive belt according to the plurality of transport distances using the transport mechanism. As a result, for example, since the moving speed of the adhesive belt is increased and the cleaning time for each unit of the surface of the adhesive belt is shortened in a case where the transport distance is long, the cleaning is performed by numerous cleaning sections. Then, since the moving speed of the adhesive belt is decreased and the cleaning time for each unit of the surface of the adhesive belt is lengthened in a case where the transport distance is short, it is possible to reduce the transport burden and to reduce the driving burden on the cleaning sections by cleaning with few cleaning sections.

A recording apparatus of a fifth aspect of the present invention is the recording apparatus according to any one of the first to fourth aspects, which is preferably provided with a moving mechanism configured and arranged to move the cleaning sections to change the distance between the cleaning sections.

According to the present aspect, the moving mechanism for the cleaning sections which is able to change the distance between the cleaning sections is provided. As a result, it is possible to change the distance between the cleaning sections to a more preferable distance based on the transport distance according to the transport mechanism.

A recording apparatus of a sixth aspect of the present invention is the recording apparatus according to any one of the first to fifth aspects, where the cleaning sections are preferably cleaning rollers having a rotating shaft in an intersecting direction intersecting with the moving direction of the adhesive belt, and configured and arranged to clean the adhesive belt by abutting with the adhesive belt, and at least one of the cleaning rollers has a rotation direction which is opposite of a rotation direction of the other of the cleaning rollers.

According to the present aspect, at least any one out of the plurality of cleaning rollers has a rotation direction which is the opposite of the other cleaning rollers. As a result, it is possible to disperse the orientation of forces which are applied to the adhesive belt from the plurality of cleaning rollers and to reduce the burden which is applied to the adhesive belt.

A recording apparatus of a seventh aspect of the present invention is the recording apparatus according to any one of the first to sixth aspects, where the plurality of cleaning sections are preferably each different types.

According to the present aspect, the plurality of cleaning sections are each different types. As a result, it is possible to, for example, divide up the functions in the plurality of cleaning sections, such as the cleaning sections at the front stage performing a rough clean, the cleaning sections at the rear stage performing a final clean, or the like.

Here, "different types" has a meaning which includes, for example, types where the structures are the same but the size and shapes are different, such as cleaning rollers with different sizes, in addition to types where the structure is different to the cleaning rollers, such as fabric wipers.

A recording apparatus of an eighth aspect of the present invention is the recording apparatus according to any one of the first to seventh aspects, where the cleaning sections are preferably cleaning rollers having a rotating shaft in an intersecting direction intersecting with the moving direction of the adhesive belt, and configured and arranged to clean the adhesive belt by abutting with the adhesive belt, each of the cleaning rollers is preferably configured and arranged such that a plurality of rollers are linked in a rotating shaft direction, and positions of linking sections for the rollers in the intersecting direction are preferably shifted for each of the cleaning rollers.

According to the present aspect, the positions of the linking sections for the plurality of rollers in the intersecting direction are provided to be shifted for each of the cleaning rollers. As a result, even when there is a portion, where the cleaning roller does not come into contact with regard to the adhesive belt, in the linking sections of the plurality of rollers and there are cleaning defects which are caused by the portion where there is no contact, it is possible to clean cleaning defect portions using other cleaning rollers and it is possible to suppress the generation of cleaning defects on the adhesive belt.

BRIEF DESCRIPTION OF THE DRAWINGS

Referring now to the attached drawings which form a part of this original disclosure.

DETAILED DESCRIPTION OF EXEMPLARY EMBODIMENTS

Embodiment 1 (FIG. 1 to FIG. 5)

Below, a recording apparatus according to an embodiment of the present invention will be described in detail with reference to the accompanying drawings.

Firstly, a recording apparatus according to embodiment 1 of the present invention will be described.

Figure 1:
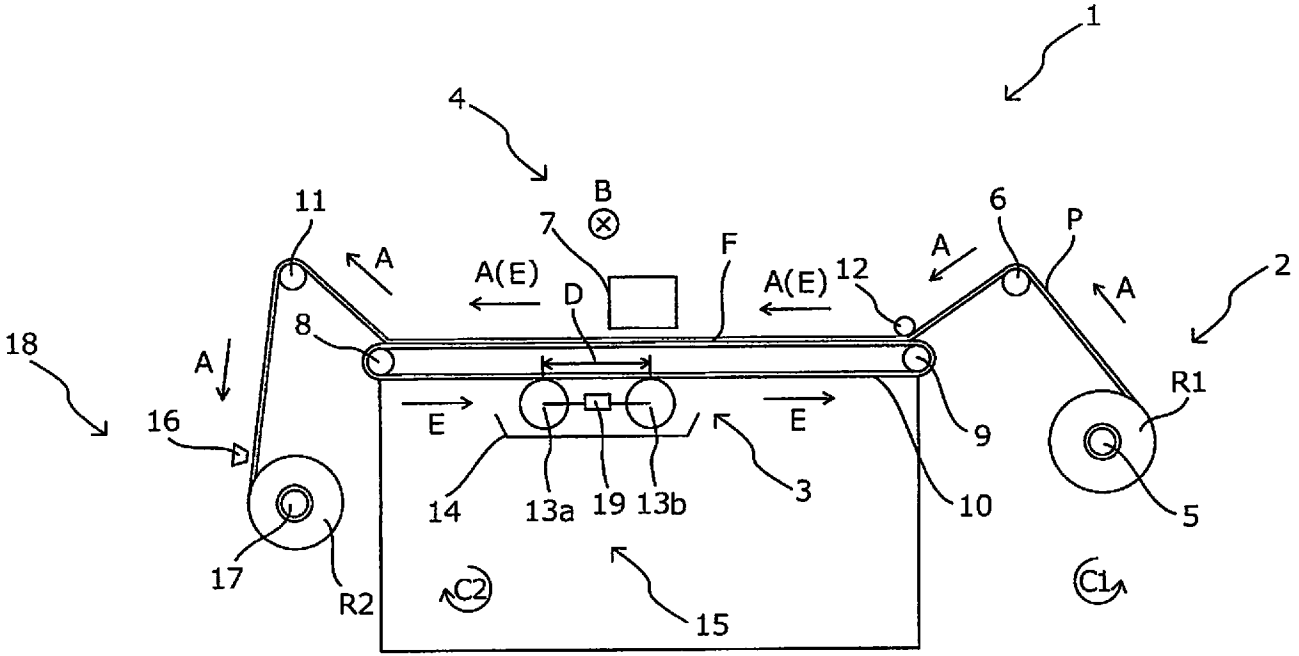
FIG. 1 is a schematic side surface diagram representing a recording apparatus according to embodiment 1 of the present invention.

FIG. 1 represents a schematic side surface diagram of a recording apparatus 1 according to embodiment 1 of the present invention.

The recording apparatus 1 of the present embodiment is provided with a feeding section 2 which is able to feed out a roll R1 of a target recording medium P in order to perform recording. In addition, there is provided a transport mechanism 3 which transports the target recording medium P in the transport direction A using an adhesive belt 10 which supports the target recording medium P on a support surface F where an adhesive is attached. In addition, there is provided a recording mechanism 4 which records by scanning a recording head 7 back and forth in an intersecting direction B which intersects with the transport direction A of the target recording medium P. In addition, there is provided a cleaning mechanism 15 which has cleaning rollers 13*a* and 13*b* as cleaning sections for the adhesive belt 10. Furthermore, there is provided a winding mechanism 18 which has a winding shaft 17 which winds the target recording medium P and a cutter 16 which cuts the target recording medium P which is wound.

The feeding section 2 has a configuration where a rotating shaft 5 is provided to also used as a setting position for the roll RI of the target recording medium P in order to perform recording and where it is possible to feed out the target recording medium P from the roll RI which is set on the rotating shaft 5 to the transport mechanism 3 via a driven roller 6. When feeding out the target recording medium P to the transport mechanism 3, the rotating shaft 5 rotates in a rotation direction C1. Here, the recording apparatus 1 of the present embodiment uses a target recording medium in a roll format as the target recording medium P, but the recording apparatus 1 is not limited to a recording apparatus which uses such a target recording medium in a roll format.

The transport mechanism 3 is provided with the adhesive belt 10 which transports the target recording medium P which is fed out from the feeding section 2 by the target recording medium P being placed on the adhesive belt 10, and a transport roller 8 and a transporting driven roller 9 which move the adhesive belt 10. The target recording medium P is placed on the support surface F of the adhesive belt 10 by being pressured and attached using a pressure roller 12. Here, when transporting the target recording medium P, the transporting driving roller 8 rotates in the rotation direction C1. Along with this, the adhesive belt 10 moves in a moving direction E.

The recording mechanism 4 has the recording head 7, a carriage which is not shown in the diagram where the recording head 7 is mounted, and a carriage motor 26 (refer to FIG. 2) which moves the carriage back and forth in an intersecting direction B. Here, the intersecting direction B in FIG. 1 is a direction which is orthogonal with regard to the paper surface.

During recording, recording is carried out by the recording head 7 being scanned back and forth, but the transport mechanism 3 stops transporting the target recording medium P during the scanning and recording (while the recording head 7 is moving). In other words, the back and forth movement of the recording head 7 and the transporting of the recording medium P are performed alternately during recording. That is, the transport mechanism 3 intermittently transports the target recording medium P during recording to correspond to the back and forth scanning of the recording head 7.

The cleaning mechanism 15 of the adhesive belt 10 is a plurality of cleaning sections which are provided from the upstream side to the downstream side of the adhesive belt 10 in the moving direction E and has the cleaning rollers 13*a* and 13*b* which have rotating shafts in a direction (the intersecting direction B) which intersects with the moving direction E of the adhesive belt 10. In addition, the cleaning mechanism 15 has a tray 14 where a cleaning agent for cleaning off ink or the like, which is attached to the cleaning rollers 13*a* and 13*b*, is held.

Here, a distance D between the cleaning rollers 13*a* and 13*b* which will be described later is different to one cycle of the transport distance which results from the intermittent transporting of the target recording medium P and is also different to any cumulative transport distance which results from a plurality of times of intermittent transporting of the target recording medium P. Here, in detail, the distance D between the cleaning rollers 13*a* and 13*b* is the distance between the centers of rotation of each of the cleaning rollers.

In addition, the cleaning roller 13*a* of the present embodiment rotates in a rotation direction C2 when cleaning the adhesive belt 10. On the other hand, the cleaning roller 13*b* of the present embodiment rotates in the rotation direction C1 when cleaning the adhesive belt 10. In other words, at least any one out of the plurality of cleaning rollers 13*a* and 13*b* has a rotation direction which is the opposite of the other cleaning rollers. As a result, there is a configuration where it is possible to disperse the orientation of forces which are applied to the adhesive belt 10 from the plurality of the cleaning rollers 13*a* and 13*b* and to reduce the burden which is applied to the adhesive belt 10. However, the present invention is not limited to this configuration.

In addition, the cleaning mechanism 15 of the adhesive belt 10 of the present embodiment is provided with a moving mechanism 19 for the cleaning rollers 13*a* and 13*b*. It is possible for the moving mechanism 19 for the cleaning rollers 13*a* and 13*b* to change the distance D between the cleaning rollers 13*a* and 13*b*. In the recording apparatus with such a configuration which is able to transport the target recording medium P a plurality of transport distances, it is possible to change the distance D to a more preferable distance based on the transport distance which is used out of the plurality of transport distances. In addition, it is also possible to move the cleaning rollers 13*a* and 13*b* in directions which approach and which move away from the adhesive belt 10. As a result, it is possible to change the number of cleaning rollers to be used when cleaning the adhesive belt 10 by a cleaning roller which is not to be used when cleaning the adhesive belt 10 being moved away from the adhesive belt 10. Furthermore, it is possible for the moving mechanism 19 for the cleaning rollers 13*a* and 13*b* to move the cleaning rollers 13*a* and 13*b* along the moving direction E of the adhesive belt 10 while preserving the distance D between the cleaning rollers 13*a* and 13*b* as it is. However, the present invention is not limited to this configuration.

The winding mechanism 18 is a mechanism which winds the target recording medium P where recording has been carried out and which is transported from the transport mechanism 3 via a driven roller 11, and it is possible to wind the target recording medium P as a roll R2 by setting a paper tube or the like for winding on the winding shaft 17 and wrapping the target recording medium P around the paper tube or the like.

Next, an electrical configuration of the recording apparatus 1 of the present embodiment will be described.

Figure 2:
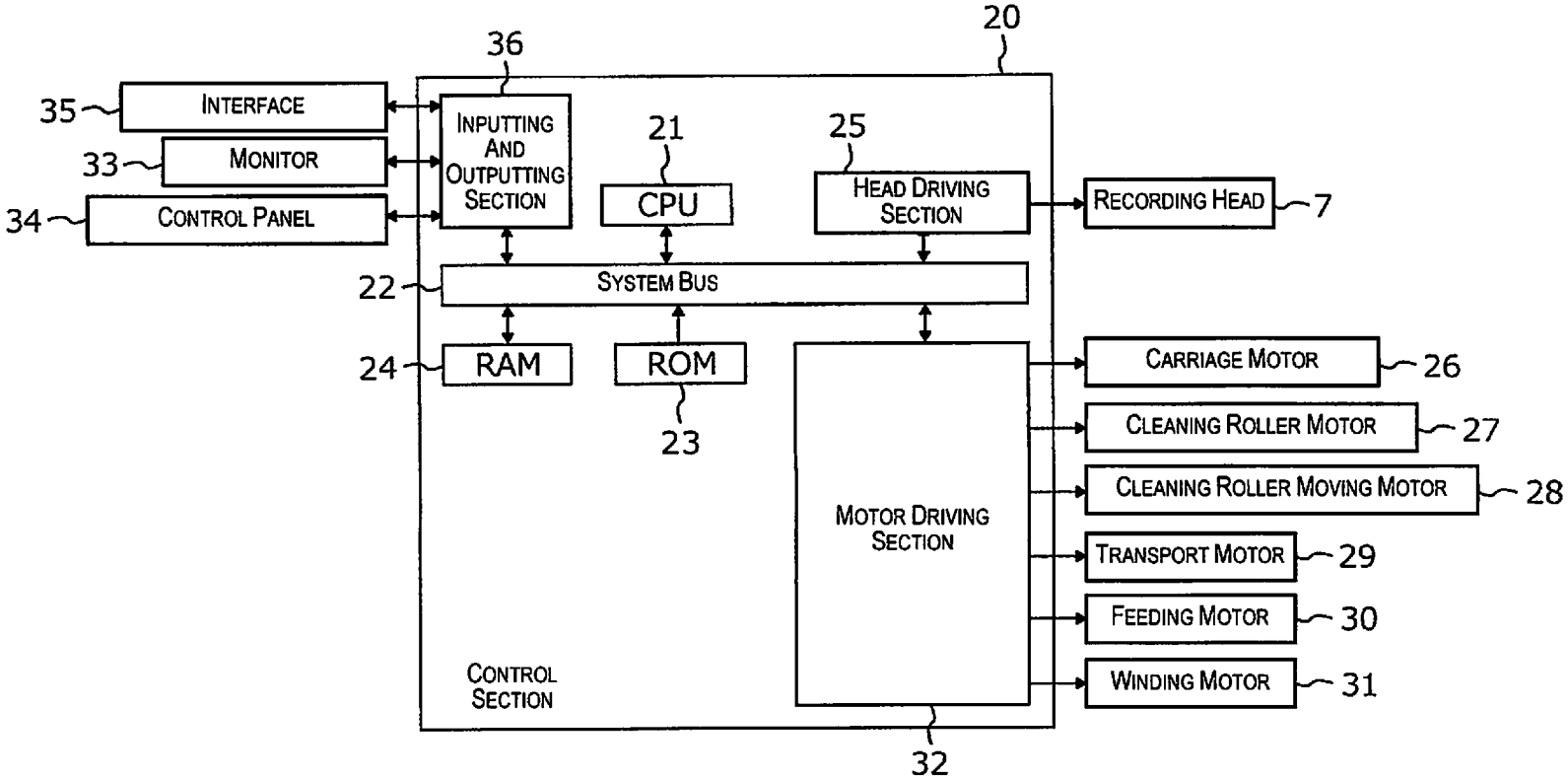
FIG. 2 is a block diagram of the recording apparatus according to embodiment 1 of the present invention.

FIG. 2 is a block diagram of the recording apparatus 1 of the present embodiment.

A control section 20 is provided with a CPU 21 which is in charge of control of the entirety of the recording apparatus 1. The CPU 21 is connected via a system bus 22 with a ROM 23, which stores various types of control programs and the like which are executed by the CPU 21, and a RAM 24 which is able to temporarily store data. In addition, the CPU 21 is connected via the system bus 22 with a head driving section 25 for driving the recording head 7.

In addition, the CPU 21 is connected via the system bus 22 with a motor driving section 32 for driving the carriage motor 26, a cleaning roller motor 27, a cleaning roller moving motor 28, a transport motor 29, a feeding motor 30, and a winding motor 31.

Here, the carriage motor 26 is a motor for moving a carriage where the recording head 7 is mounted. In addition, the cleaning roller motor 27 is a motor for rotationally driving the cleaning rollers 13*a* and 13*b*. In addition, the cleaning roller moving motor 28 is a motor for driving the moving mechanism 19 for the cleaning rollers 13*a* and 13*b*. In addition, the transport motor 29 is a motor for driving the transport roller 8. In addition, the feeding motor 30 is a rotation mechanism for the rotating shaft 5 and is a motor for driving the rotating shaft 5 in order to feed out the target recording medium P to the transport mechanism 3. Then, the winding motor 31 is a driving motor for rotating the winding shaft 17.

Furthermore, the CPU 21 is connected with a monitor 33 and a control panel 34 which are provided in the recording apparatus 1, an interface 35 for inputting recording data or the like from an external apparatus such as a personal computer or the like, and an inputting and outputting section 36 for performing sending and receiving of data and signals.

The transport mechanism 3 of the present embodiment is able to transport the target recording medium P one transport distance which is determined in advance as one cycle of the transport distance which results from the intermittent transporting of the target recording medium P. In addition, the transport mechanism 3 is also able to transport the target recording medium P another plurality of transport distances which is determined in advance as one cycle of the transport distance which results from the intermittent transporting of the target recording medium P. The control section 20 performs controlling of the transport mechanism 3 in the intermittent transporting of the target recording medium P.

In addition, it is possible for the control section 20 to change the number of the cleaning rollers 13*a* and 13*b* to be used when cleaning the adhesive belt 10 according to the transport distance by controlling the moving mechanism 19 for the cleaning rollers 13*a* and 13*b*. Here, for the cleaning rollers which are not used in the cleaning of the adhesive belt 10, it is possible to stop the rotation of the cleaning rollers by the cleaning rollers being moved away from the adhesive belt 10 and it is possible for the rotation of the cleaning rollers in a state of not having been moved away to be driven by the movement of the adhesive belt 10. However, the present invention is not limited to this configuration.

Next, the relationship between the one cycle of the transport distance which results from the intermittent transporting of the target recording medium P and the distance D between the plurality of cleaning rollers 13*a* and 13*b* will be described in detail.

Figure 3:
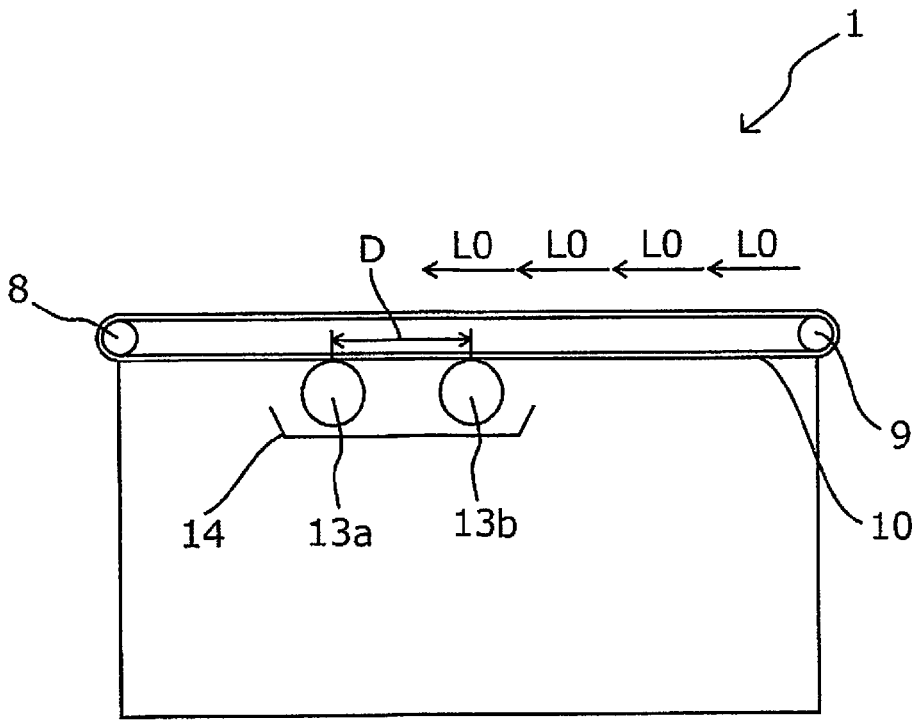
FIG. 3 is a schematic side surface diagram representing the distance between a plurality of cleaning rollers in the recording apparatus according to embodiment 1 of the present invention.

FIG. 3 is a schematic side surface diagram representing the relationship between the distance D between the cleaning rollers 13*a* and 13*b* in the recording apparatus 1 of the present embodiment and a transport distance L0 in a case of transporting one transport distance L0 which is determined in advance as one cycle of the transport distance which results from the intermittent transporting of the target recording medium P.

In the recording apparatus 1 of the present embodiment, the distance D between the cleaning rollers 13*a* and 13*b* is a non-integer multiple of the transport distance L0. As a result, in a case where the target recording medium P is transported by the transport distance L0, it is possible to suppress overlapping of portions which are cleaned by the cleaning roller 13*a* in the stationary state and portions which are cleaned by the cleaning roller 13*b* in the stationary state and to suppress uneven wear of the adhesive belt 10 which results from intermittent transporting of the target recording medium P.

Figure 4:
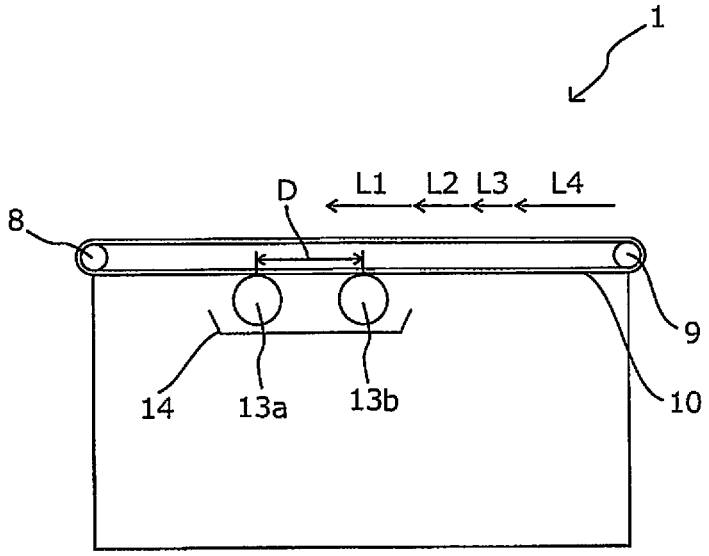
FIG. 4 is a schematic side surface diagram representing the distance between a plurality of cleaning rollers in the recording apparatus according to embodiment 1 of the present invention.

FIG. 4 is a schematic side surface diagram representing the relationship between the distance D between the cleaning rollers 13*a* and 13*b* in the recording apparatus 1 of the present embodiment and transport distances L1, L2, L3, and L4 in a case of transporting by a plurality of transport distances L1, L2, L3, and L4 which are determined in advance as one cycle of the transport distance which results from the intermittent transporting of the target recording medium P.

In the recording apparatus 1 of the present embodiment, the distance D between the cleaning rollers 13*a* and 13*b* is different to each of the plurality of transport distances L1, L2, L3, and L4 and is also different to any cumulative transport distances of the plurality of transport distances L1, L2, L3, and L4. For example, the distance D between the cleaning rollers 13*a* and 13*b* is different to all cumulative transport distances such as L1+L2, L1+L2+L3, L1+L2+L3+L4, L1+L2+L3+L4+L1, L1+L2+L3+L4+L1+L2, and the like. As a result, in a case where the target recording medium P is transported by a combination of the plurality of transport distances L1, L2, L3, and L4, it is possible to suppress overlapping of portions which are cleaned by the cleaning roller 13*a* in the stationary state and portions which are cleaned by the cleaning roller 13*b* in the stationary state and to suppress uneven wear of the adhesive belt 10 which results from intermittent transporting of the target recording medium P.

Here, it is possible for the recording apparatus 1 of the present embodiment to transport the target recording medium P by each of the transport distances of the plurality of transport distances L1, L2, L3, and L4 in addition to transporting the target recording medium P by a combination of the plurality of transport distances L1, L2, L3, and L4. Then, in the recording apparatus 1 of the present embodiment, the distance D between the cleaning rollers 13*a* and 13*b* is a non-integer multiple of each of the transport distance L1, L2, L3, and L4.

Next, the cleaning rollers 13*a* and 13*b* of the present embodiment will be described in detail.

Figure 5:
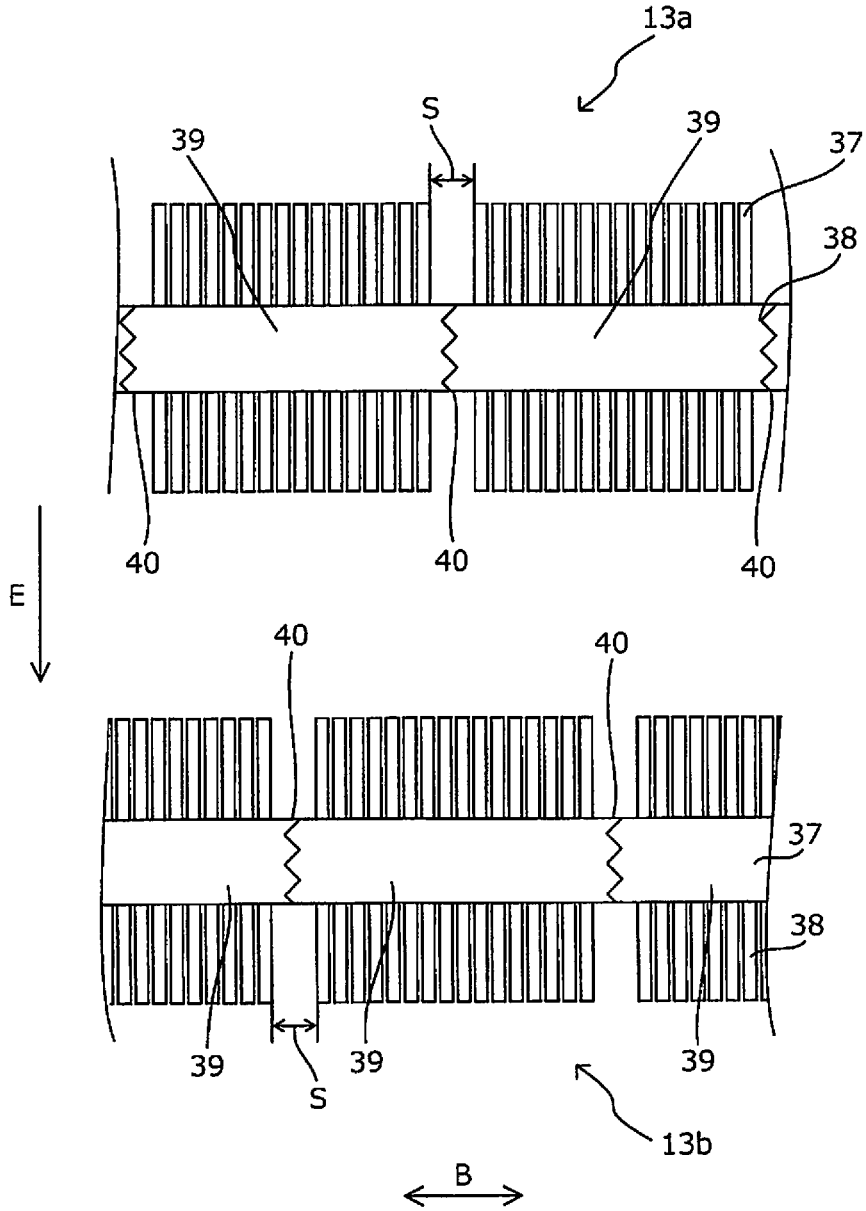
FIG. 5 is a schematic diagram where the cleaning rollers of the recording apparatus according to embodiment 1 of the present invention are viewed from a bottom surface side of the recording apparatus.

FIG. 5 is a schematic diagram where the cleaning rollers 13*a* and 13*b* of the present embodiment are viewed from a bottom surface side of the recording apparatus 1.

Both of the cleaning rollers 13*a* and 13*b* of the present embodiment are configured by linking a plurality of rollers 39, which are formed of a brush section 37 which comes into contact with the adhesive belt 10 and a shaft section 38 which forms a rotating shaft along the intersecting direction B which intersects with the moving direction E of the adhesive belt 10, in the intersecting direction B which is the direction of the rotating shaft.

The cleaning rollers 13*a* and 13*b* of the present embodiment are configured by rollers 39 which have the same size, and spaces S are opened in linking sections 40 of the rollers 39. However, positions of the linking sections 40 for the plurality of rollers 39 in the intersecting direction B are provided to be shifted for each of the cleaning rollers 13*a* and 13*b*. Due to such a configuration, even when there is a portion, where the cleaning roller 13*a* does not come into contact with regard to the adhesive belt 10, in the linking sections 40 of the plurality of rollers 39 and there are cleaning defects which are caused by the portion where there is no contact due to the cleaning roller 13*a* at the front stage, it is possible for the recording apparatus 1 of the present embodiment to clean the cleaning defect portions using the cleaning roller 13*b* at the rear stage and it is possible to suppress the generation of cleaning failures on the adhesive belt 10.

Figure 6:
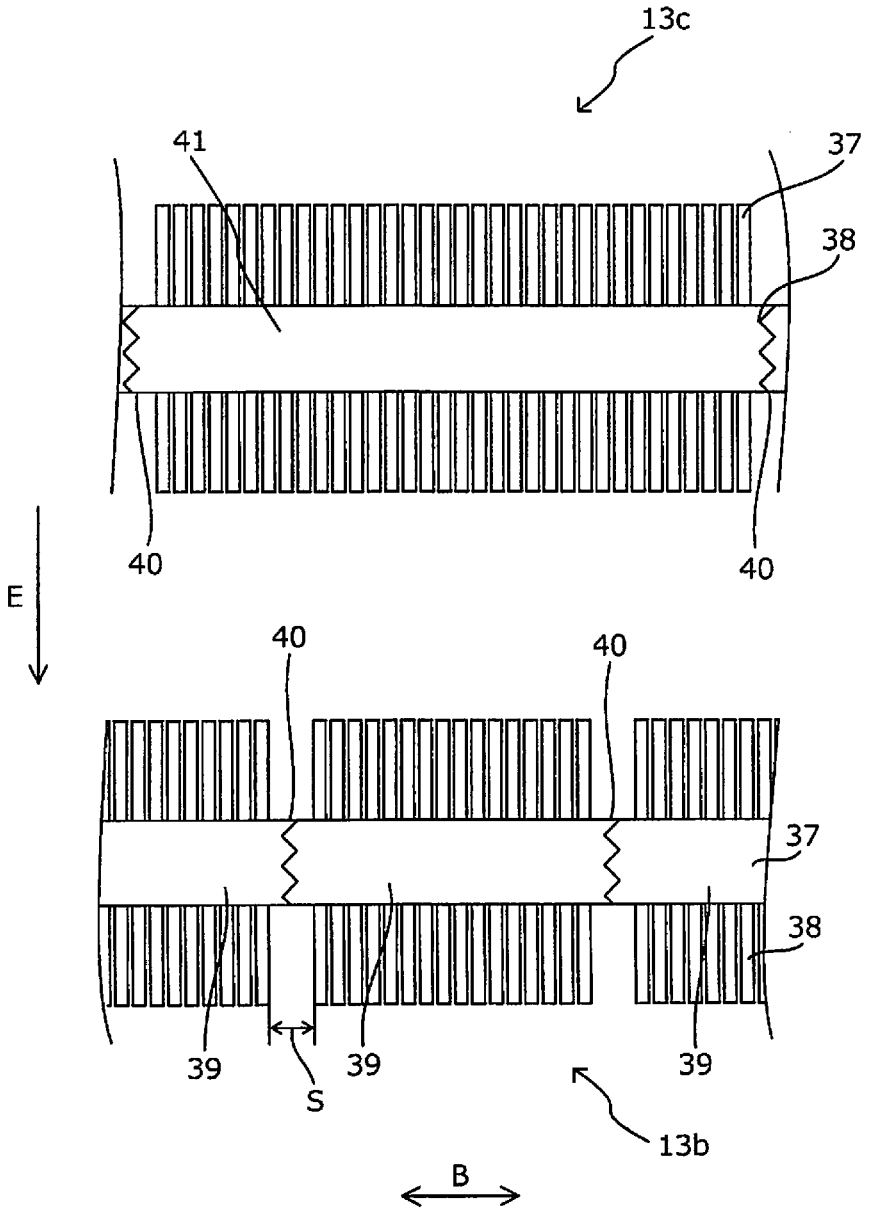
FIG. 6 is a schematic diagram where cleaning rollers of a recording apparatus according to embodiment 2 of the present invention are viewed from the bottom surface side of the recording apparatus.

Example 2 (FIG. 6)

Next, the recording apparatus according to embodiment 2 of the present invention will be described.

FIG. 6 is a schematic diagram where cleaning rollers 13*c* and 13*b* of the recording apparatus 1 according to embodiment 2 of the present invention are viewed from the bottom surface side of the recording apparatus 1. Here, the constituent members which are in common with the embodiments described above are indicated by the same reference numerals, and detailed description of these members will be omitted.

The recording apparatus 1 of the present embodiment is different to the recording apparatus 1 of embodiment 1 in the point that a plurality of cleaning sections which are each different types are provided.

The recording apparatus 1 of the present embodiment is provided with the cleaning roller 13*c* instead of the cleaning roller 13*a*. The cleaning roller 13*c* is different to the cleaning roller 13*a* in the point that the cleaning roller 13*c* is configured by rollers 41 where the length in the intersecting direction B which is the rotating shaft direction is double the length of the rollers 39. Here, in the recording apparatus 1 of the present embodiment, positions of the linking sections 40 for the cleaning roller 13*c* and the cleaning roller 13*b* in the intersecting direction B are provided to be shifted for each of the cleaning rollers 13*c* and 13*b*. As a result, in the same manner as the recording apparatus of embodiment 1, even when there is a portion, where the cleaning roller 13*c* does not come into contact with regard to the adhesive belt 10, in the linking sections 40 of the plurality of rollers 39 and there are cleaning defects which are caused by the portion where there is no contact due to the cleaning roller 13*c* at the front stage, it is possible for the recording apparatus 1 of the present embodiment to clean the cleaning defect portions using the cleaning roller 13*b* at the rear stage and it is possible to suppress the generation of cleaning failures on the adhesive belt 10.

Here, the recording apparatus 1 of the present embodiment has a cleaning roller which has rollers with different shapes as the cleaning sections which are different types, but the present invention is not limited to this configuration. For example, the cleaning roller, the fabric wiper, and the like may be combined as the cleaning sections which are different types.

By using cleaning sections which are different types such as in the recording apparatus 1 of the present embodiment, it is possible, for example, to divide up the functions in the plurality of cleaning sections, such as the cleaning sections at the front stage performing a rough clean, the cleaning sections at the rear stage performing a final clean, or the like.

Other Embodiments

Here, the recording apparatuses 1 of embodiments 1 and 2 are both provided with two cleaning rollers as the cleaning sections, but the recording apparatuses 1 of embodiments 1 and 2 may have cleaning sections which are different to the cleaning rollers, such as fabric wipers, as the cleaning sections, or may have configurations which are provided with three or more cleaning sections.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a transport mechanism having an adhesive belt configured and arranged to support a target recording medium thereon to intermittently transport the target recording medium; and a plurality of cleaning sections arranged from an upstream side to a downstream side along the adhesive belt in a moving direction to clean the adhesive belt by abutting against the adhesive belt, wherein a distance between the cleaning sections is different to a transport distance of the target recording medium which is transported by a single time of intermittent transporting of the target recording medium and is also different to a cumulative transport distance of the target recording medium which is transported by a plurality of times of intermittent transporting of the target recording medium, and the transport mechanism is configured and arranged to transport the target recording medium by a single transport distance which is determined in advance as the transport distance of the target recording medium which is transported by a single time of the intermittent transporting the distance between the cleaning sections being a distance between portions of the cleaning sections that abut against the adhesive belt and being a non-integer multiple of the transport distance of the target recording medium which is transported by a single time of the intermittent transporting.

2. The recording apparatus according to claim 1, wherein the transport mechanism is configured and arranged to transport the target recording medium by a plurality of transport distances which are determined in advance as the transport distance of the target recording medium which is transported by a single time of the intermittent transporting, and the distance between the cleaning sections is different to each of the transport distances and is also different to the cumulative transport distance of the transport distances.

3. The recording apparatus according to claim 2, wherein a number of the cleaning sections used when cleaning the adhesive belt is changeable according to the transport distances using the transport mechanism.

4. The recording apparatus according to claim 1, further comprising a moving mechanism configured and arranged to move the cleaning sections to change the distance between the cleaning sections.

5. The recording apparatus according to claim 1, wherein the cleaning sections are cleaning rollers having a rotating shaft in an intersecting direction intersecting with the moving direction of the adhesive belt, and configured and arranged to clean the adhesive belt by abutting with the adhesive belt, and at least one of the cleaning rollers has a rotation direction which is opposite of a rotation direction of the other of the cleaning rollers.

6. The recording apparatus according to claim 1, wherein the cleaning sections are different types of rollers.

7. The recording apparatus according to claim 1, wherein the cleaning sections are groups of cleaning rollers having a rotating shaft in an intersecting direction intersecting with the moving direction of the adhesive belt, and configured and arranged to clean the adhesive belt by abutting with the adhesive belt, each group of the cleaning rollers is configured and arranged such that a plurality of rollers are linked in a rotating shaft direction, and positions of linking sections for the rollers in the intersecting direction are shifted for each group of the cleaning rollers.

8. The recording apparatus according to claim 1, wherein the cleaning sections are different types of cleaning sections.

* * * * *